US005759207A

United States Patent [19]

Green

[11] Patent Number: 5,759,207

[45] Date of Patent: Jun. 2, 1998

[54] FLAT DUCK GREIGE FABRICS SUITABLE FOR PROCESSING INTO FLAME RESISTANT FABRICS WITH LOW SHRINKAGE

[75] Inventor: James R. Green, Bonita Springs, Fla.

[73] Assignee: Itex, Inc., Aurora, Colo.

[21] Appl. No.: 787,943

[22] Filed: Jan. 23, 1997

[51] Int. Cl.[6] ..... D06M 11/69; D03D 25/00

[52] U.S. Cl. ..... 8/115.7; 8/139; 8/195; 8/127.1; 8/490; 8/494; 427/393.3; 442/189; 442/301; 442/143; 442/214; 442/215; 442/216

[58] Field of Search ..... 8/139, 115.7, 195, 8/127.1, 490, 494; 427/393.3; 442/189, 301, 143, 214, 215, 216

[56] References Cited

U.S. PATENT DOCUMENTS

| | | | |
|---|---|---|---|
| 4,286,012 | 8/1981 | Zins et al. | 442/214 |
| 4,900,613 | 2/1990 | Green | 442/214 |
| 5,468,545 | 11/1995 | Fleming et al. | 8/115.7 |

*Primary Examiner*—Alan Diamond
*Attorney, Agent, or Firm*—Terry M. Gernstein

[57] ABSTRACT

Improved flat duck griege cotton/thermoplastic fiber blend fabrics have been discovered which are suitable for processing into flame resistant fabrics with low laundry shrinkage while maintaining high resistance to molten metal.

15 Claims, No Drawings

FLAT DUCK GREIGE FABRICS SUITABLE FOR PROCESSING INTO FLAME RESISTANT FABRICS WITH LOW SHRINKAGE

DESCRIPTION

This invention relates to flat duck cotton/thermoplastic fiber blend greige fabrics which can be flame-retardant treated and still maintain their ability to resist penetration by molten metal and to be compressively shrunk by sanforization to obtain less than 5% laundry shrinkage after five washes. The fabrics have a warp cover factor of no more than 0.80 and a cloth cover factor of no less than 0.75.

BACKGROUND

The high fatigue resistance of thermoplastic fibers can increase the wear life of garments made primarily of cotton and it is therefore highly desireable to include them in flame resistant cotton fabrics as is described in U.S. Pat. No. 4,920,000. However, when these blends are used in tightly woven flat duck fabrics, which is a style commonly worn by welders, the fabrics become stiff and lose pliability such that they cannot be compressively shrunk by sanforization to obtain low laundry shrinkage. This problem is not encountered with flame-retardant treated 100% cotton flat duck fabrics.

It is thought that when thermoplastic fibers are introduced into the flat duck construction they have a much higher friction against flame-resistant cotton fibers than flame-resistant cotton fibers have between themselves. Because flat duck fabrics, as designed for welders, have tight construction to prevent molten metal penetration, further reduction in pliability caused by increased fiber friction makes it very difficult to control laundry shrinkage by sanforizing the fabrics.

In general the addition of tough thermoplastic and thermoset fibers to cotton blend fabrics to improve abrasion and burn through resistance is well known, as are the benefits of flame retarding such fabrics. U.S. Pat. Nos. 5,480,458, and 5,468,545 describe nylon/cotton blend fabrics made with a flame retardant which lasts the life of the garment. U.S. Pat. Nos. 4,900,613 and 4,941,884 describe the use of blends of thermoplastic and high modulus fibers with cotton to obtain resistance to hard surface abrasion. U.S. Pat. No. 4,909,805 describes a two step process for applying flame retardant to blends of cotton and thermoplastic fibers. It would be highly desireable to be able to apply this technology to flat duck welding fabric without losing the ability to reduce laundry shrinkage to a level acceptable for wearing apparel.

SUMMARY OF THE INVENTION

It has been discovered that by restricting the number of ends in the warp of flat duck greige fabrics containing cotton/thermoplastic fibers such that the warp cover factor is no more than 0.80, while maintaining sufficient warp and fill ends to obtain a cloth cover factor of no less than 0.75, a suitable greige fabric precursor for a flame resistant, low laundry shrinkage flat duck fabric with high resistance to molten metal can be obtained. Fabrics of this invention have a basis weight of 270 to 508 gm/m$^2$ (8 to 15 oz/yd$^2$) and contain 50 to 95% cotton fibers and 5 to 30% thermoplastic fibers.

DETAILED DESCRIPTION OF THE INVENTION

Duck fabrics are compact, firm, heavy, and of plain-weave construction. Plied yarn duck has plied yarns in both the warp and the filling. Flat duck has a warp of two single yarns woven as one and a filling of either single or plied yarn. Flat duck is preferred by welders because the use of single yarns in the warp helps to improve fabric flexibility and strength and are the subject of this invention.

Greige fabric construction as described herein refers to the condition of the fabric on the loom. Generally such fabrics contain chemical size applied to the warp such as starch, as an aid to weaving. Yarn weights as described herein refer to the yarn weights prior to application of chemical size. Greige fabric weight as described herein does include the weight of the chemical additive. In general yarn linear weights of 39 to 197 tex (15 to 3 1/cc) are used to provide high fabric thickness and tear strength. A basis weight of 270 to 508 gm/m$^2$ (8 to 15 oz/yd$^2$) is needed to provide adequate protection to welders.

The amount of area covered by yarns in a fabric is called the cloth cover factor. The amount of cover provided by a fabric is important to welders because of the need to prevent penetration of molten metal. Cloth cover factor is determined as described in RESEARCH DISCLOSURE, October, 1988, Publication Item No. 29498, "Calculation of Fabric Tightness Factor", pp.833–6. Fabrics of this invention have a cloth cover factor of no less than 0.75 when calculated using on loom fabric construction and yarn weights without chemical size.

The warp and fill cover factors are the ratio of the actual number of threads in a given length of fabric to the theoretical maximum which can be placed in the fabric, depending upon yarn linear weight and fabric weave, either warp or filling. It is surprising that flat duck fabrics containing cotton/thermoplastic fiber blends which have been flame retarded suffer a significant deterioration in their response to sanforization when the warp cover factor exceeds 0.80 whereas similar fabrics of 100% cotton do not. Fabrics of this invention have a warp cover factor of no more than 0.80.

The staple fibers used herein are textile fibers having a linear density suitable for wearing apparel, i.e., less than 10 decitex per fiber, preferably less than 5 decitex per fiber. Still more preferred are fibers that have a linear density of 1 to 3 decitex per fiber and length from 1.9 to 6.3 cm (0.75 to 2.5 in). Crimped fibers are particularly good for textile aesthetics and processibility.

It is important to maintain the proper fiber content types to achieve the desired results. If the fabric contains more than 30% thermoplastic fibers, molten metal drops will burn through rapidly, thereby increasing the hazard to the wearer. Too little thermoplastic fiber will result in no improvement in wear life compared with 100% cotton fabrics.

Thermoplastic fibers with a melting point above 200 deg C. such as 66 and 6 nylon, polyethylene terephthalate and other polyesters, must be used to prevent loss of fabric durability well below the degradation temperature of cotton.

While this invention relates primarily to cotton/thermoplastic fiber blends, synthetic thermoset fibers may also be added in limited quantities to provide other benefits such as increased heat resistance or to modify the appearance or hand. Many synthetic thermoset fibers are suitable such as rayon, poly(p-phenylene terephthalamide) (PPD-T), polybenzimidazol and poly(m-phenylene isophthalamide), polyacrylinitrile and other acrylics, polyimides and novoloids such as that made under the trade name Kynol.

At least two satisfactory commercial products are available for flame-retardant treatment. One is "Pyroset" TPO, a THPS/urea precondensate of tetrakis (hydroxymethly) phosphonium sulfate and urea available from Freedom Chemical Company, Charlotte, N.C.. The other is THPC/urea prepolymer condensate of tetrakis (hydroxymethly) phosphonium chloride and urea licensed by Albright and Wilson, Richmond, Va. and is known as the "Proban" process.

The Proban process is described in detail in the following U.S. Pat. Nos. 4,078,101; 4,145,463; 4,311,855 and 4,494,951, all to Albright and Wilson. The information in these references is helpful to explain the chemistry of the THP salt/urea precondensation process. However, these disclosures do not reveal how to make cotton/thermoplastic fiber blend flat duck flame resistant fabrics which have low laundry shrinkage and high cloth cover.

Compressive shrinkage is a treatment which is frequently applied commercially to fabric for the purpose of minimizing the shrinkage of the fabrics after laundering. In the compressive shrinkage process the fabric may be dampened, and held firmly against a heavy elastic blanket forcing the fabric to comply and shrink. When fabrics lack sufficient compliance, they do not shrink uniformly and can develop a crepe appearance which must be avoided. If fabrics crepe readily, it will not be possible to obtain acceptable laundry shrinkage by this method. Fabrics of this invention do not crepe even when compressively shrunk to obtain less than 5% shrinkage after 5 home washes. Home washing consists of laundering the fabric at about 60 deg. C., with detergent alternated with drying in a drier after each wash.

During processing of the fabrics of the invention durable press resins may be applied to the fabric. Many other conventional fabric treatments may also be carried out on the fabrics such as mercerization, application of dyes, hand builders and softeners and framing.

EXAMPLE 1

Flat duck fabric was made having in the warp 25 wt % of polyhexamethylene adipamide (6,6 nylon) fibers having a linear density of 2.77 dtex (2.5 dpf) and a length of 3.8 cm (1.5 in) (available as T-420 nylon from Dupont) and 75% cotton. Warp yarn linear density was 66 tex (8.9 1/cc). The fill was made from two plies of the same yarn type. The fabric had a nylon content of 25% and cotton content was 75%. The fabric in the greige condition on the loom had 62 warp ends and 26 ends in the fill direction resulting in a warp cover factor of 0.76 and a fabric cover factor of 0.87. Basis weight including size was 356 gm/$m_2$ (10.5 oz/yd$^2$). The fabric was dyed and sufficient flame retardant applied to deposit 2.9% phosphorus on the fabric. Shrinkage was less than 3% after five home launderings.

EXAMPLE 2

Fabric was made and processed like example 1 with the exception that yarns were made with 15% 6,6 nylon and 85% cotton fibers. The fabric contained 2.6% phosphorus and shrinkage was less than 3% have five launderings.

Comparative examples A–D not of the invention and described in Table 1 were made similar to Example 1 but with warp cover factors exceeding 0.80 for illustration. Only example D made with 100% cotton could be sanforized to obtain no more than 5% shrinkage after 5 washes. Yarn linear weights shown in Table 1 refer to single yarns only, whether single or plied.

TABLE 1

| CONTROL FABRICS NOT OF THE INVENTION | | | |
|---|---|---|---|
| EXAMPLE | WARP COVER FAC-TOR | 5 WASH SHRINKAGE AFTER FLAME RETARDING, SANFORIZATION | CLOTH COVER FAC-TOR |
| A. | | | |
| WARP 75/25% COTTON/NYLON<br>66 TEX (8.9 CC) SINGLES<br>68 ENDS<br>FILL 100% COTTON<br>66 TEX TWO PLIED<br>26 ENDS | .84 | 7% | .91 |
| B. | | | |
| WARP 65/25/10% COTTON/NYLON/PPD-T.<br>54 TEX (11 CC) SINGLES<br>73 ENDS<br>FILL<br>90/10% COTTON/PPD-T<br>33 ENDS<br>118 TEX (5 CC) SINGLES | .81 | 7% | .91 |
| C. | | | |
| WARP 65/25/10% COTTON/NYLON/PPD-T.<br>54 TEX (11 CC) SINGLES<br>73 ENDS<br>FILL<br>100% COTTON<br>28 ENDS<br>74 TEX (8 CC) TWO PLIED | .81 | 6% | .91 |
| D. | | | |
| WARP 100% COTTON<br>66 TEX (8.9 CC) SINGLES<br>76 ENDS<br>FILL 100% COTTON<br>66 TEX (8.9 CC) TWO PLIED<br>26 ENDS | .93 | 3% | .97 |

I claim:

1. A greige flat duck fabric having a basis weight of 270 to 508 gm/m$^2$ (8 to 15 oz/yd$^2$); a warp cover factor no greater than 0.80; a cloth cover factor no less than 0.75; and being comprised of 50 to 95% cotton fibers and 5 to 30% thermoplastic fibers.

2. The fabric defined in claim 1 further including 5 to 30% thermoset fibers.

3. The fabric as defined in claim 1 wherein said thermoplastic fibers are only in the warp yarns.

4. The fabric defined in claim 1 in which said thermoplastic fibers are nylon.

5. The fabric of claim 1 in which said thermoplastic fibers are polyester.

6. The fabric defined in claim 2 in which said thermoset fibers are poly (p-phenylene terephthalamide).

7. A process for making a flat duck flame resistant fabric with low laundry shrinkage and a high cloth cover factor comprising: providing a flat duck greige fabric having a basis weight of 270 to 508 gm/m$^2$ (8 to 15 oz/yd$^2$); a warp cover factor no greater than 0.80; a cloth cover factor no less than 0.75; and being comprised of 50 to 95% cotton fibers; 5 to 30% thermoplastic fibers; scouring to remove size, applying a durable flame retardant of a prepolymer of urea and tetrakis (hydroxymethyl) phosphonium salt in a manner sufficient to fix at least 2% phosphorus by weight of treated fabric in the fabric, followed by sanforization.

8. The process defined in claim 7 further including dyeing the greige fabric after scouring to obtain colored fabrics.

9. The process defined in claim 7 wherein the greige fabric further includes 5 to 30% thermoset fibers.

10. The process defined in claim 7 wherein the thermoplastic fibers are only in the warp yarns.

11. The process defined in claim 7 wherein the thermoplastic fibers are nylon.

12. The process defined in claim 7 wherein the thermoplastic fibers are polyester.

13. The process defined in claim 9 wherein the thermoset fibers are poly (p-phenylene terephthalamide).

14. A flame resistant fabric made by the process of providing a greige fabric having a basis weight of 270 to 508 $gm/m^2$ (8 to 15 $oz/yd^2$); a warp cover factor of no greater than 0.80; a cloth cover factor no less than 0.75; and being comprised of 50 to 95% cotton fibers; 5 to 30% thermoplastic fibers; scouring to remove size, applying a durable flame retardant of prepolymer of urea and tetrakis (hydroxymethyl) phosphonium salt in a manner to fix at least 2% phosphorus by weight of finished fabric in the fabric, followed by sanforization.

15. The flame resistant fabric defined in claim 14 wherein said process further includes dyeing the greige fabric after scouring to obtain colored fabrics.

* * * * *